US006957980B2

(12) United States Patent
Huang et al.

(10) Patent No.: US 6,957,980 B2
(45) Date of Patent: Oct. 25, 2005

(54) INSERT TYPE SUPER MINI MICROWAVE CONNECTOR

(75) Inventors: Tung-Liang Huang, Taipei Hsien (TW); Sung-Wen Chen, Taipei Hsien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 10/428,079

(22) Filed: May 2, 2003

(65) Prior Publication Data

US 2004/0219836 A1 Nov. 4, 2004

(51) Int. Cl.[7] ..... H01R 9/05
(52) U.S. Cl. ..... 439/581; 439/608; 439/63
(58) Field of Search ..... 439/608, 63, 581, 439/578

(56) References Cited

U.S. PATENT DOCUMENTS 3,539,966 A * 11/1970 Logan ..... 439/63
4,737,111 A * 4/1988 Minar et al. ..... 439/63
5,190,474 A * 3/1993 Ginet ..... 439/581
6,106,304 A * 8/2000 Huang ..... 439/63
6,238,218 B1 * 5/2001 Baffert ..... 439/63
6,457,979 B1 * 10/2002 Dove et al. ..... 439/63
6,572,406 B2 * 6/2003 Guidet ..... 439/578
6,607,400 B1 * 8/2003 Ko ..... 439/581
6,676,443 B1 * 1/2004 Wang ..... 439/581

* cited by examiner

*Primary Examiner*—Briggitte R. Hammond
(74) *Attorney, Agent, or Firm*—Troxell Law Office, PLLC

(57) ABSTRACT

An insert type super mini microwave connector includes a socket for being joined to a circuit board. The socket further includes an outer metal casing, which extends a lateral joining part, and an insulator associated with the metal casing, which has a metal male terminal keeping not contacting with the metal casing and also extending a lateral joining part. The joining parts are joined to the facial side of the circuit board so as to allow the male terminal facing the circuit board laterally and to allow the socket being attached to a lateral side of the circuit board. An entire height of the connector and the circuit board, which is disposed in an electronic product for being attached with the connector, can be reduced to allow the electronic product having a thinner appearance, providing better signal transmission quality and being fabricated easily.

4 Claims, 11 Drawing Sheets

INSERT TYPE SUPER MINI MICROWAVE CONNECTOR

BACKGROUND OF THE INVENTION

1. Field of the Invention

The present invention relates to a connector, and particularly to a super mini sized microwave connector with the socket thereof being soldered to a circuit board.

2. Description of Related Art

The inventor previously has filed a patent application of super mini microwave connector in Taiwan and U.S.A respectively. The Taiwanese application was assigned an application number 90219559 and the U.S. patent application was assigned an application Ser. No. 10/035,313. Further, the Taiwanese application number 90219559 has been allowed with Publication No. 510608.

With reference to FIGS. 1A and 1B, the super mini microwave connector includes a socket 10 and a plug 20. The socket 10 at the bottom thereof can be soldered to a circuit board 30 of an electronic product such as a notebook computer, a personal digital assistant or a mobile phone. The plug 20 is inserted into the socket 10. The plug 20 at an end thereof is connected to a transmission wire 40. The transmission wire at another end thereof can be connected to, for example, an antenna of the mobile phone for receiving or sending signals. The socket 10 has a metal casing 11 and the metal casing 11 at the lower end thereof joins with an insulator 12. The insulator 12 is inserted into the casing 11 and the central part of the insulator 12 forms a projection end 121 to receive a male terminal 13. The male terminal 13 at the lower end 131 thereof is a shape of plate extending outward the insulator 12 and the casing 11 so as to be soldered to the upper end of the circuit board 30. The plug 20 has a metal outer shell 21 joining with an insulator 22 and the insulator 22 has a hollow part to fit with a female terminal 23. The female terminal 23 is composed of two opposite touch plates 231 spacing apart a small distance from each other. When the plug 20 is inserted into the socket 10, the two touch plates 231 of the female terminal 23 in the plug 20 are fitted to two lateral sides of the male terminal 13 in the socket 10 so as to allow two signal ends connecting with each other. The outer shell 21 fits with the outer side of the casing 11 such that two grounding ends can connect with each other.

The preceding cited reference has the socket 10 being joined to the upper end of the socket 10 and the plug 20 is then joined to the upper end of the socket 10. Once the connector is attached to the circuit board 30, the connector with the circuit board 30 has a height such that an electronic product at the interior thereof has to be arranged a sufficient space above the circuit board for accommodating the connector. The female terminal 23 of the plug 20 and the outer shell 21 have to be bent 90° such that more fabrication time is necessary to make the connector. Further, the two touch plates 231 of the female terminal 23 have a 90° bent so that a transmission route composed of the transmission wire 40, the female terminal 23 and the male terminal 13 has a 90° bend, which degrades signal transmission quality.

SUMMARY OF THE INVENTION

The crux of the present invention is to reduce the height resulting from the connector engaging with the circuit board and to enhance the quality of signal transmission.

A primary object of the present invention is to provide an insert type super mini microwave connector so as to reduce the height of an electronic product after the connector being attached to the circuit board such that a thinner appearance of the electronic product can be obtained advantageously.

Another object of the present invention is to provide an insert type super mini microwave connector, which is possible to enhance quality of signal transmission and it is capable of being fabricated easily.

BRIEF DESCRIPTION OF THE DRAWINGS

The present invention can be more fully understood by reference to the following description and accompanying drawing, in which.

DETAILED DESCRIPTION OF THE PREFERRED EMBODIMENTS

Figure 1A:
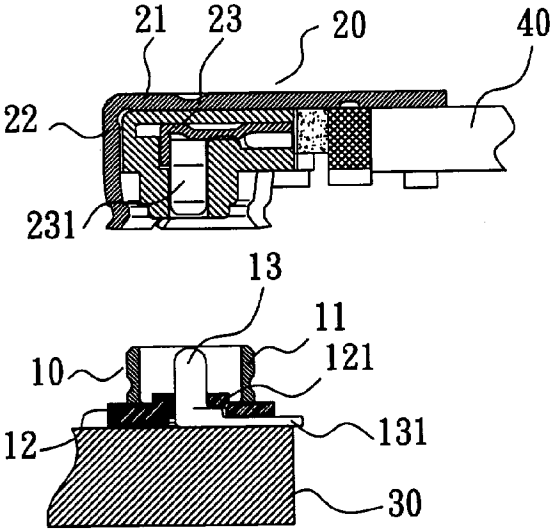
FIG. 1A (Prior art)
FIGS. 1A and 1B are sectional views of conventional super mini microwave connector showing a state of being detached and a state of being joined.
Figure 1B:
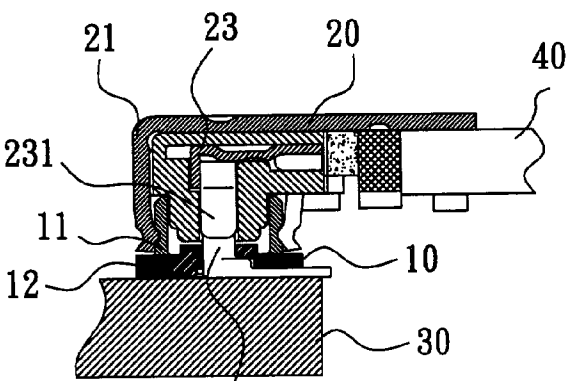
FIG. 1B (Prior art)
Figure 2A:
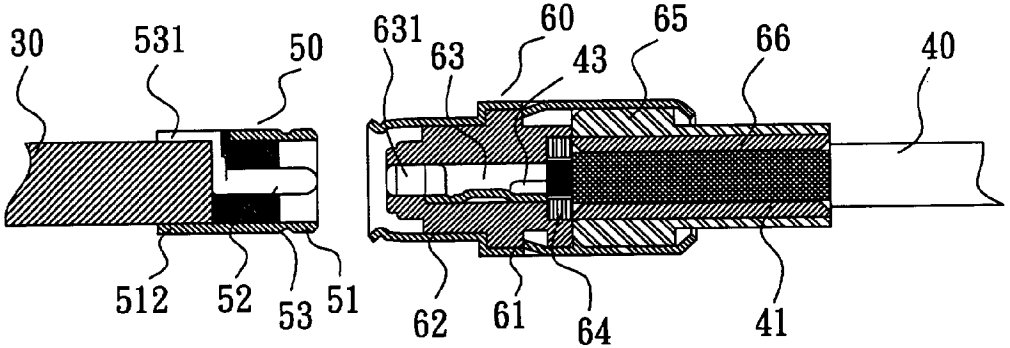
FIGS. 2A and 2B are sectional views of an insert type super mini microwave connector according to the present invention showing a state of detached and a state of being joined.
Figure 2B:
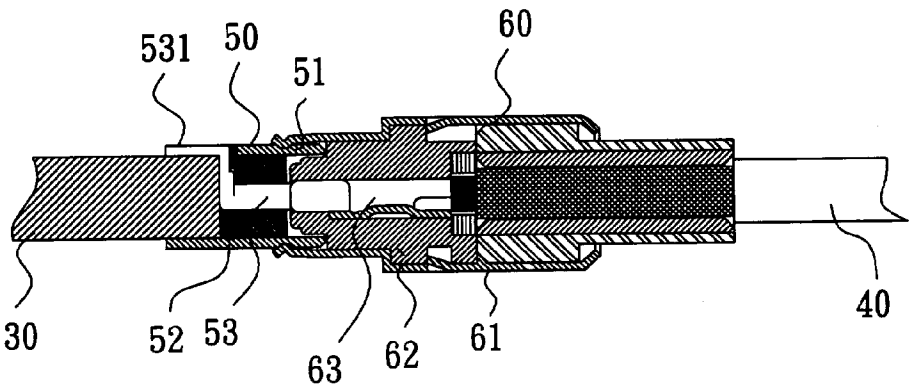
Figure 3C:
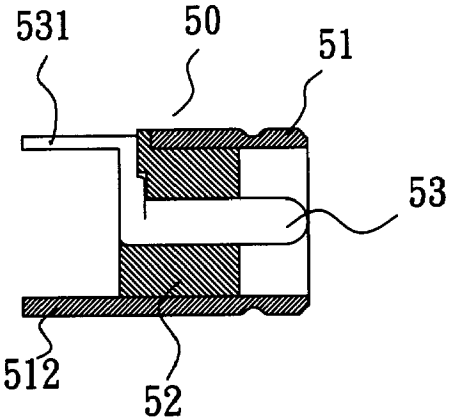
FIG. 3C is a sectional view of the socket shown in FIG. 3A.
Figure 5:
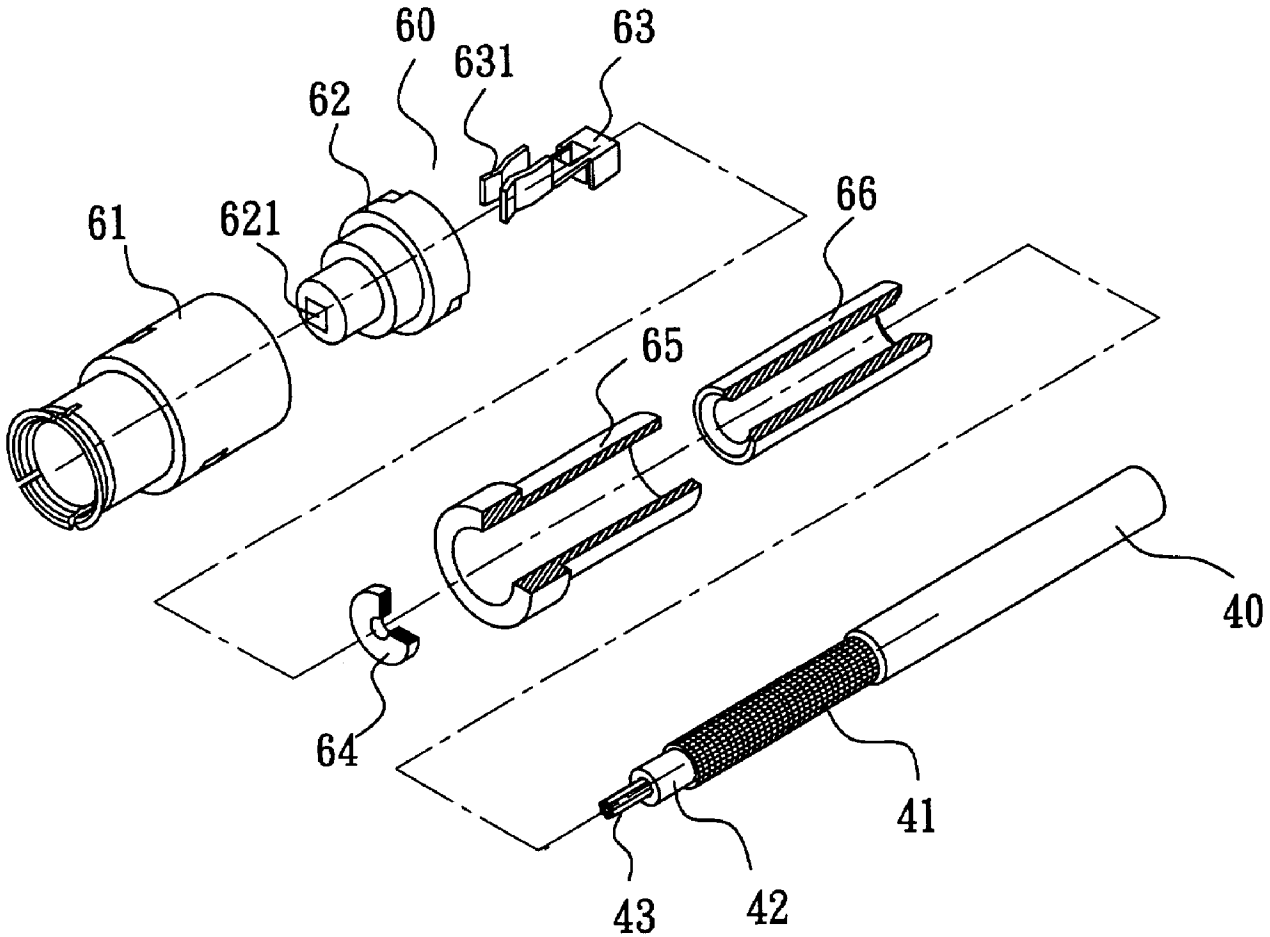
FIG. 5 is a disassembled perspective view of a plug for the insert type super mini connector of the present invention illustrating component parts and a transmission line thereof.

With reference to FIGS. 2A and 2B, an insert type super mini microwave connector of the present invention in a first embodiment thereof includes a socket 50 and a plug 60. The socket 50 includes an outer metal casing 51 associated with an insulator 52 as shown in FIGS. 3A, 3B and 3C. The insulator 52 is attached with a metal male terminal 53 keeping not contacting the casing 51. The outer casing 51 and the male terminal 53 extend laterally a joining part 511, 531 respectively and the outer casing 51 further extends laterally a hold plate 512. The joining parts 511, 531 are soldered to a facial side of a circuit board 30 respectively and the hold plate 512 is joined to another facial side of the circuit board 30 so that the socket 50 can be inserted a lateral side of the circuit board 30 with the male terminal 53 laterally facing the circuit board 30. The plug 60 as shown in FIG. 5 includes a metal casing 61, an insulator 62, a female terminal 63, an insulation ring 64, an outer metal sleeve 65 and an inner metal sleeve 66. The inner sleeve 66 is fixed to the outer side of a grounded wire 41 of the transmission wire 40. The outer sleeve 65 is fitted to the outer side of the inner sleeve 66. The insulation ring 64 is fitted to the outer side of an insulation tube 42 and fitted to the inner side of the insulator 62. The signal wire 43 is soldered to the rear end of the female terminal 63. The female terminal 63 at the front end thereof has two opposite touch plates 631 spacing apart from each other a small distance. The female terminal 63 is engaged to a through hole 621 of the insulator 62. The casing 61 is fitted to the outer sides of the insulator 62 and the outer sleeve 65 so as to fix the component parts in the plug 60 and the transmission wire 40.

A feature of the insert type super mini microwave connector according to the present invention is in that the socket 50 is engaged to a lateral side of the circuit board 30 instead of the upper end thereof and the plug 60 is joined to the socket 50 at the lateral side of the circuit board 30. Hence, the height of the connector can be lowered largely after being engaged to the circuit board 30 so that the electronic product can obtain a thinner appearance.

Another feature of the insert type super mini microwave connector according to the present invention according to the present invention is in that the signal transmission wire 40, the female terminal 63 and the male terminal 53 are connected to each other in a line to provide a better signal transmission quality and it is possible for the plug 60 to be fabricated much easily due to the casing 61 and the female terminal 63 keeping unbent so as to reduce defect rate and save production cost.

Figure 3D:
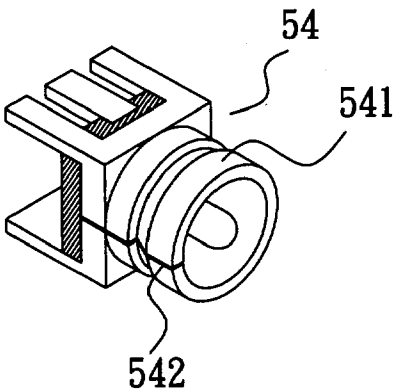
FIG. 3D is a perspective view of another preferred embodiment of the socket.
Figure 3A:
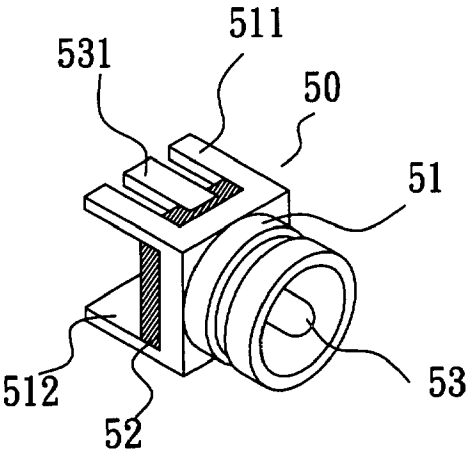
FIG. 3A is a perspective view of a socket for an insert type super mini microwave connector according to the present invention in a preferred embodiment thereof.
Figure 3B:
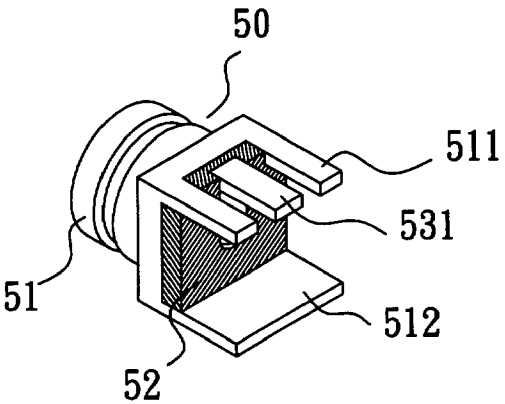
FIG. 3B is another perspective view of the socket shown in FIG. 3A.

With reference to FIGS. 3A and 3D, the socket 50 of the present invention has an outer casing 51 made with stamping and drawing, lathing or die-casting. The socket 54 has an outer casing 541 made with stamping and wrapping so that a seam 542 is formed.

Figure 4A:
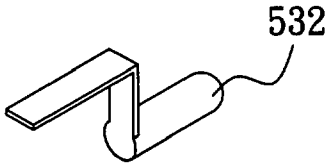
FIGS. 4A, 4B and 4C are perspective views illustrating different male terminals for the socket according to the present invention.
Figure 4B:
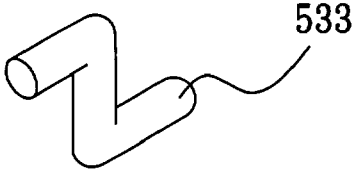
Figure 4C:
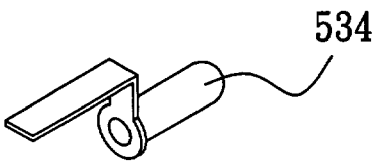

With reference to FIGS. 4A, 4B and 4C, the male terminal 532 according to the present invention is a solid piece made by way of stamping and the male terminal 533 is made by way of lathing. Further, the male terminal 534 is made by way of stamping and drawing.

Figure 6C:
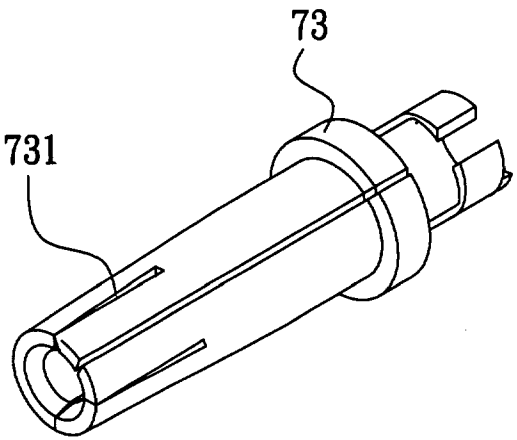
FIGS. 6A, 6B and 6C are perspective views of different embodiments for a female terminal in the plug of the present invention.
Figure 6B:
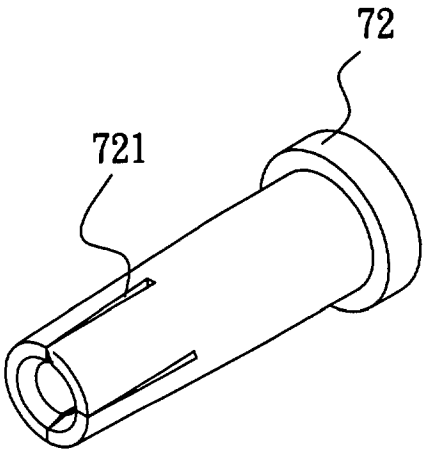
Figure 6A:
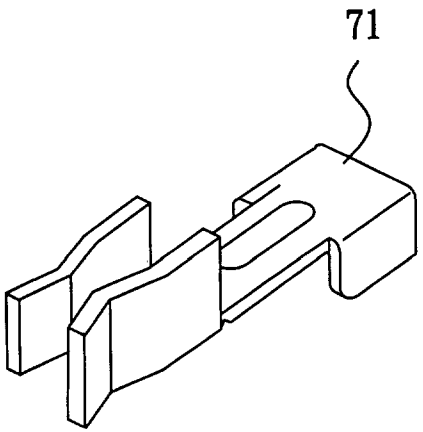
Figure 7A:
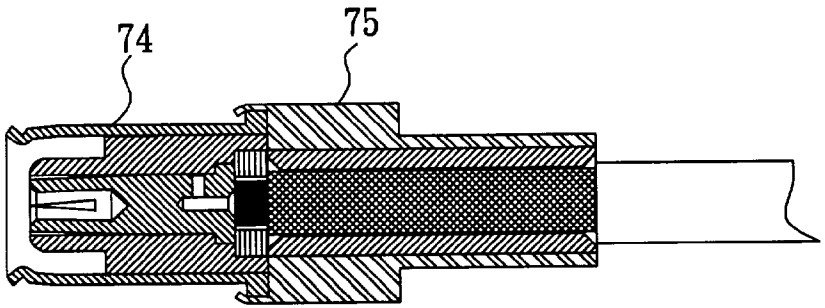
FIGS. 7A, 7B, 7C, and 7D are sectional views illustrating different casings and fitting tubes for the plug in different combinations.
Figure 7B:
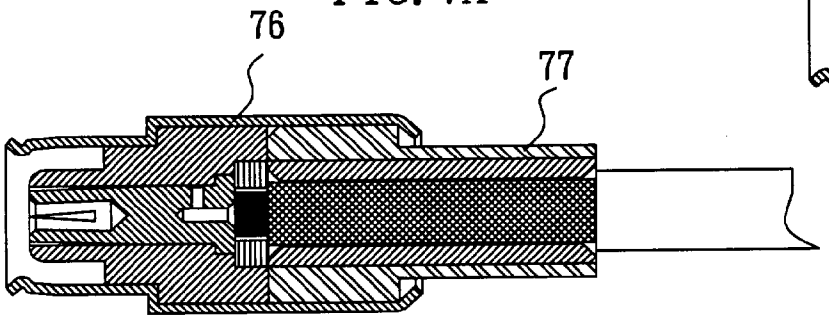
Figure 7C:
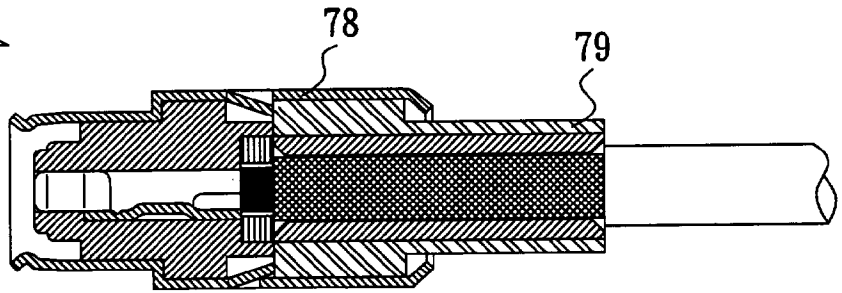
Figure 7D:
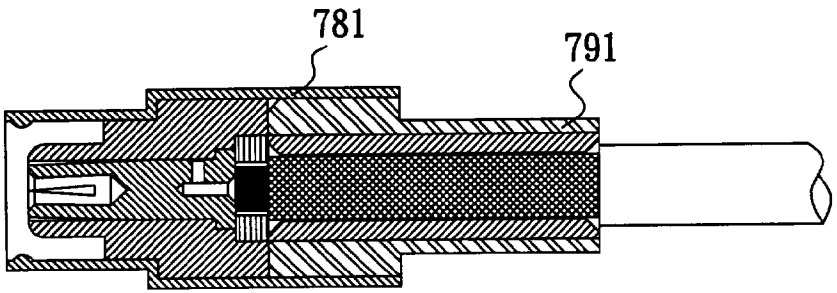

With reference to FIGS. 6A, 6B and 6C, the female terminal 71 according to the present invention is made by way of stamping and drawing and the female terminal 72 is made by way of stamping and drawing or by way of lathing. The female terminal 73 is made by way of stamping and wrapping. The female terminals 72, 73 at front ends thereof have a shape of sleeve respectively. The sleeves have a slit head 721, 731 respectively so as to elastically fit with the male terminals.

With reference to FIGS. 7A, 7B, 7C, and 7D both the outer shell and the outer fitting tube of the female terminal in the plug according to the present invention have different combination types. The outer shell 74 at the rear end thereof is fitted to the inner side of the outer fitting tube 75 at the front end thereof. The outer fitting tubes 77, 79 at the front ends thereof are fitted to the inner sides of the outer shells 76, 78 respectively. The outer shell 781 is fabricated by way of a lathe and the rear end of the outer shell 781 at the inner side thereof forcedly fits with an outer fitting tube 791.

Figure 8:
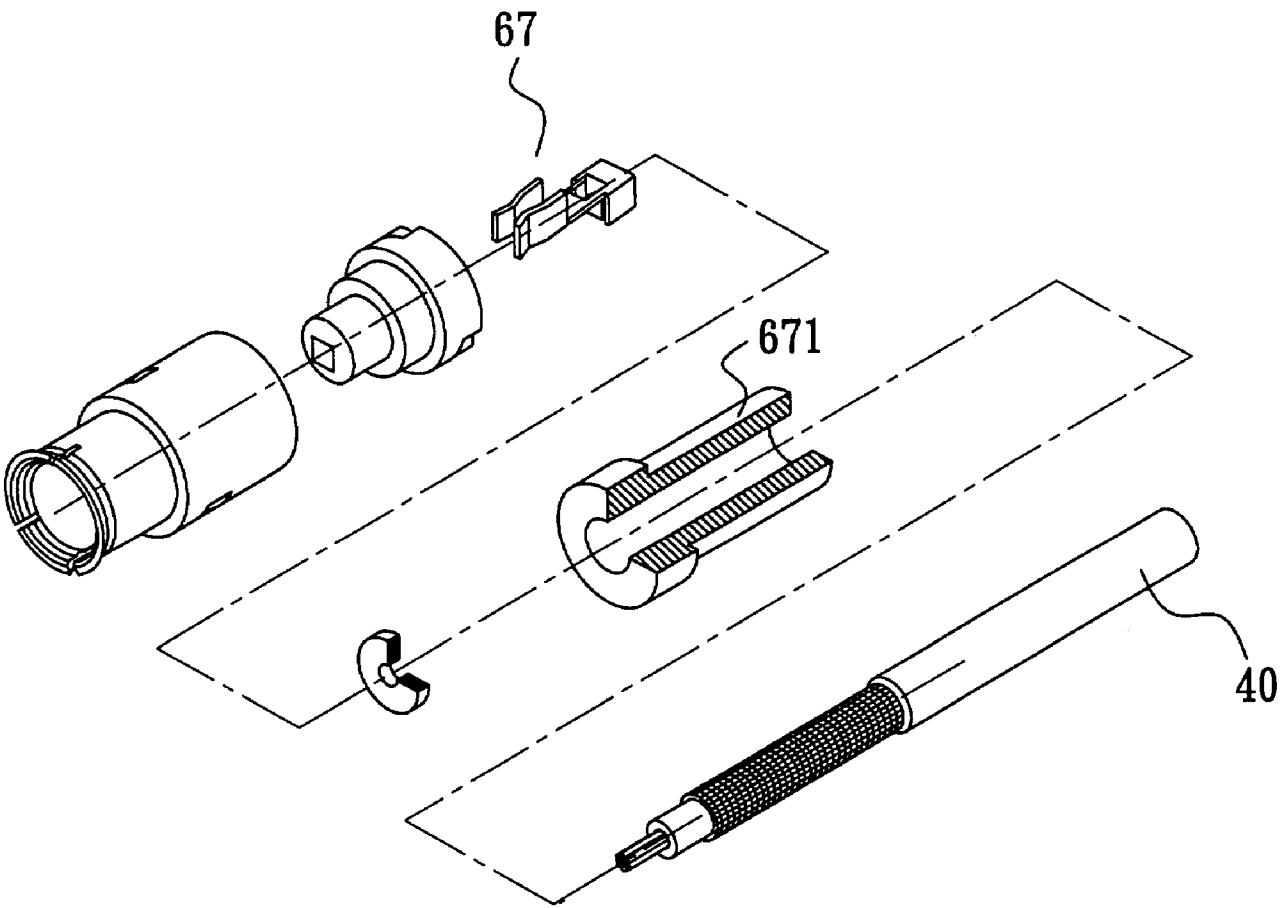
FIG. 8 is a disassembled perspective view of another embodiment of the plug according to the present invention illustrating component parts and a transmission line thereof.
Figure 9A:
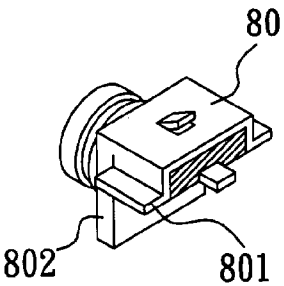
FIGS. 9A to 9J are perspective views of different embodiments of the socket according to the present invention.
Figure 9B:
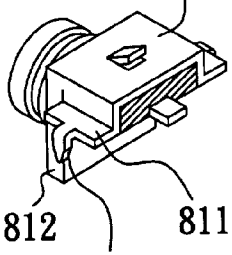
Figure 9C:
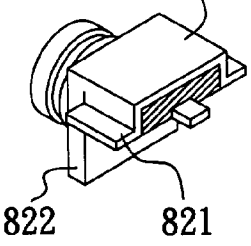
Figure 9D:
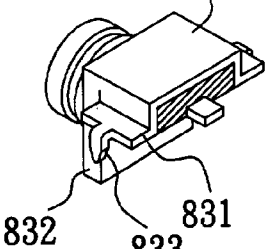
Figure 9E:
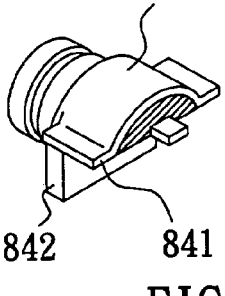
Figure 9F:
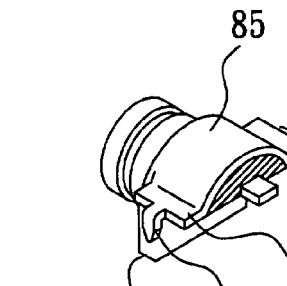
Figure 9G:
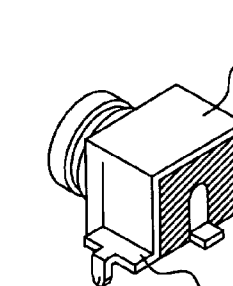
Figure 9H:
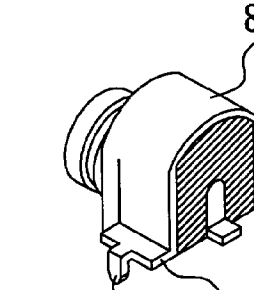
Figure 9I:
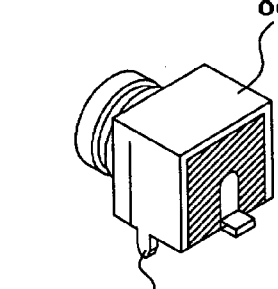
Figure 9J:
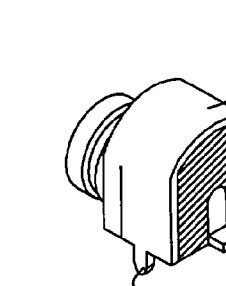

With reference to FIG. 8 in company with FIG. 5, the plug 67 is another embodiment in addition to the plug shown in FIG. 5. The plug 67 is similar to the plug shown in FIG. 5 except a metal fitting tube 671 of the plug 67 instead of the metal outer fitting tube 65 and the inner fitting tube 66 in the plug shown in FIG. 5.

With reference to FIGS. 9A to 9J, sockets 80, 81, 82, 83, 84, 85, 86 and 87 at lower rear ends of the outer casings thereof extend a joining part 801, 811, 821, 831, 841, 851, 861, 871 respectively toward two lateral sides. The sockets 80, 81, 82, 83, 84 and 85 at lower ends thereof extend a front plate 802, 812, 822, 832, 842 and 852 respectively for pressing against the edge of the circuit board. The sockets 81, 83, 85, 86, 87 at the joining parts 811, 831, 851, 861 and 871 thereof extend downward an insert pin 813, 833, 853, 862 and 872 respectively for being inserted into a corresponding hole at the circuit board. The sockets 80, 81, 82, 83, 86 and 88 at the rear upper ends of the outer casings thereof have a parallelepiped shape respectively. The sockets 84, 85, 87 and 89 at the rear upper ends of the outer casings thereof have an arched shape. The sockets 88 and 89 at the joining parts 881 and 882 of the outer casings thereof have a shape of insert pin respectively for being inserted into a corresponding hole in the circuit board. The sockets 80, 81, 82, 83, 84 and 85 can be attached to a lateral side of the circuit board. The sockets 86, 87, 88 and 89 can be attached to the upper end of the circuit board and it is possible to reduce the total height of the connector associated with the circuit board even if the plug 60 shown in FIG. 2A is included.

Figure 10A:
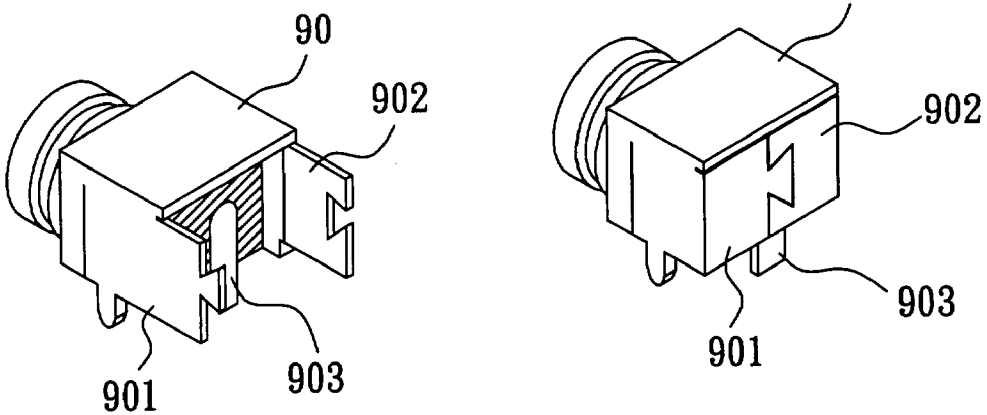
FIGS. 10A and 10B are perspective views of further embodiment of the socket according to the present invention illustrating rear covers being attached to the socket.
Figure 10B:
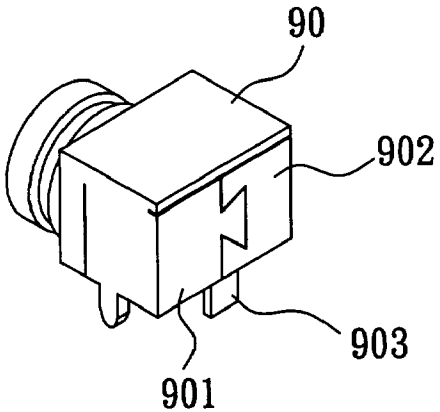
Figure 10C:
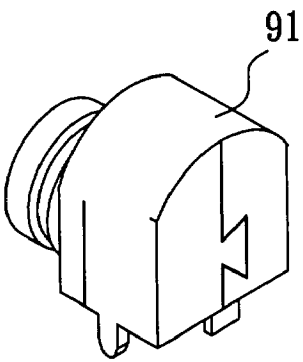
FIGS. 10C to 10F are perspective views illustrating different embodiments for the socket with rear covers according to the present invention.
Figure 10D:
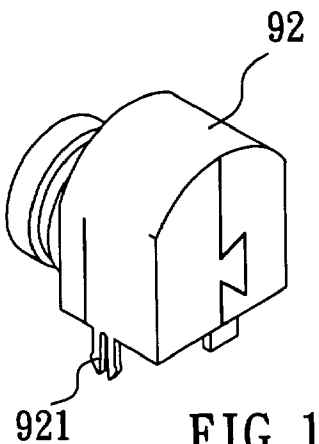
Figure 10E:
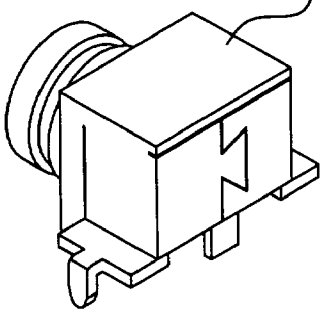
Figure 10F:
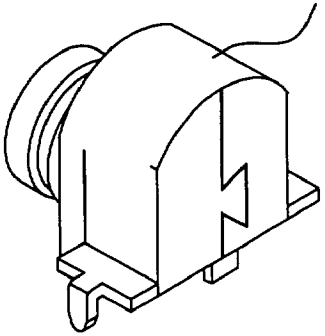

With reference to FIGS. 10A and 10B, the socket 90 at the rear end of the outer casing thereof has a rear cover and the rear cover is composed of two engaging cover plates 901, 902. Further, the male terminal has a joining part 903 extending downward.

With reference to FIGS. 10C to 10F, sockets 91, 92, 93, and 94 at the rear ends of the outer casings thereof have a rear cover respectively and the male terminal at the joining part thereof extends downward. The socket 92 at the outer casing thereof extends downward a joining part 921 and the joining part 921 at the middle area thereof has a slit and at both lateral sides thereof has a shape of inverted hook.

Figure 11C:
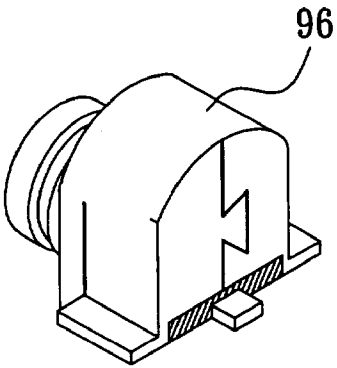
FIGS. 11C to 11E are perspective views illustrating further different embodiments for the socket with rear covers according to the present invention.
Figure 11B:
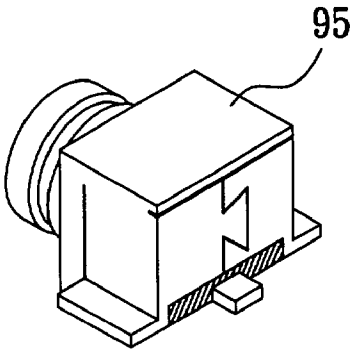
FIGS. 11A and 11B are perspective views illustrating a further embodiment for the socket with rear covers according to the present invention.
Figure 11A:
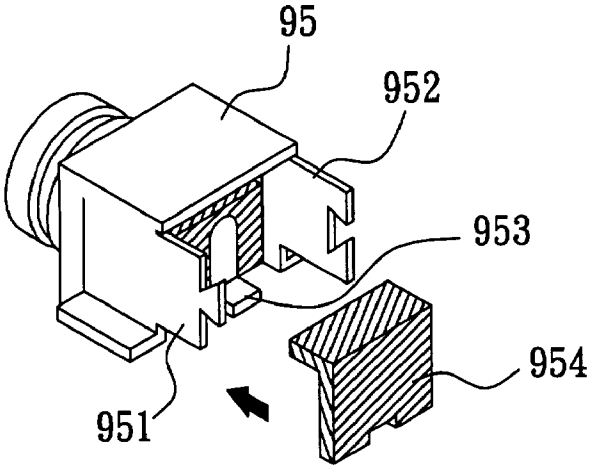

With reference to FIGS. 11A and 11B, a socket 95, which is a further embodiment in addition to the preceding embodiments, at the rear end of the outer casing thereof has a rear cover composed of two engaging cover plates 951, 952. But, the male terminal has the joining part 953 thereof bending downward 90° from the rear lower side of the rear cover so that it has to be added a rear insulator 954 as a partition between the male terminal with the joining part thereof and the rear cover.

Figure 11E:
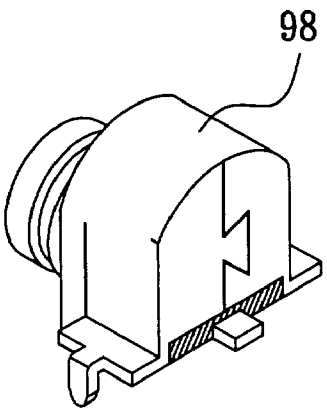
Figure 11D:
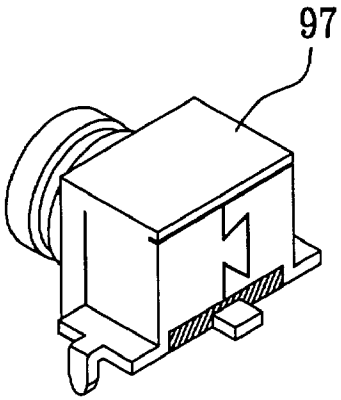
Figure 12C:
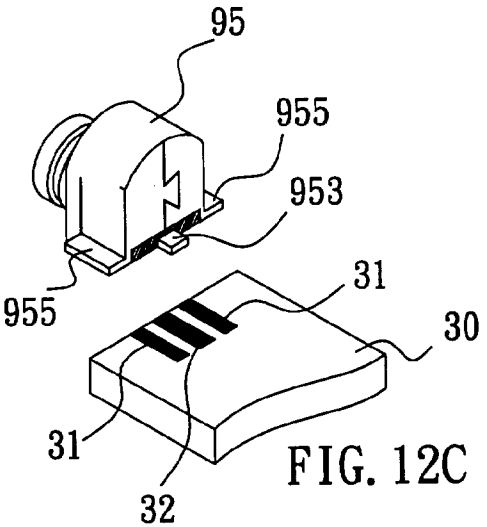
FIGS. 12A to 12F are perspective views illustrating the different embodiments for the socket of the present invention being attached with a print circuit board respectively.
Figure 12B:
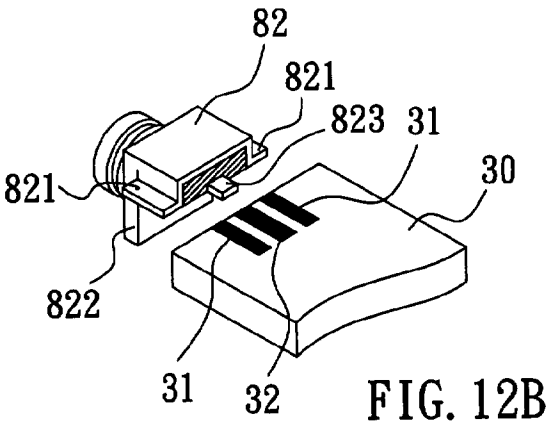
Figure 12A:
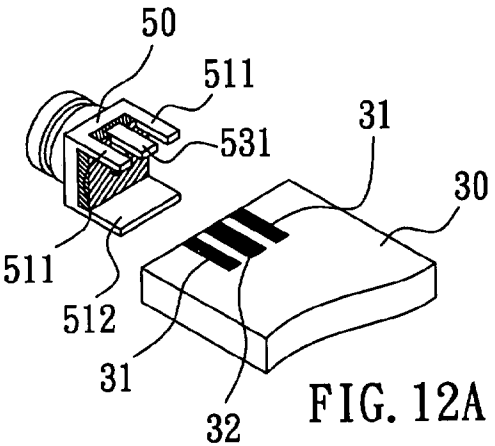
Figure 12F:
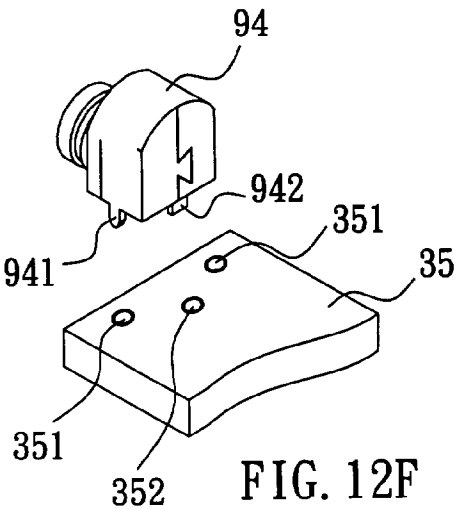
Figure 12E:
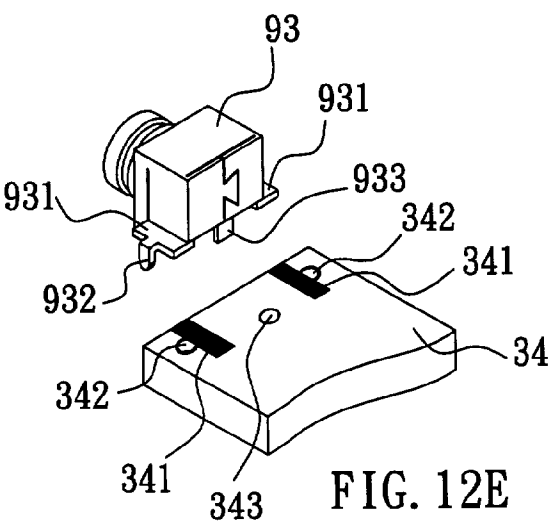
Figure 12D:
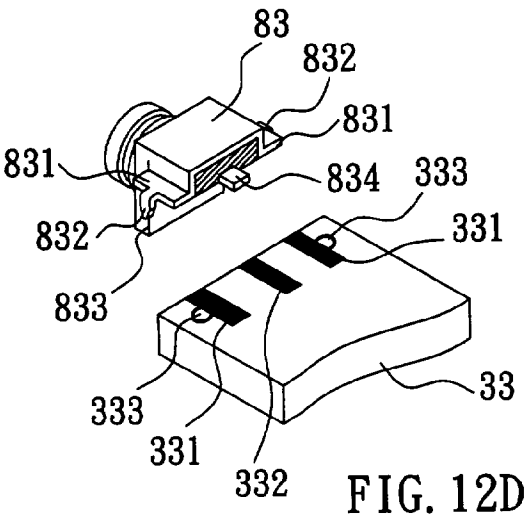

With reference to FIGS. 11C, 11D and 11E, sockets 96, 97 and 98 also have a rear cover, a rear side insulator and a male terminal with a joining part having a reward 90° bent.

With reference to FIGS. 12A to 12F, the socket 50 at the outer casing thereof and the male terminal at the joining parts 511, 531 thereof can be soldered to corresponding electrical connecting parts 31, 32. The holding plate 512 is joined to the reversed side of the circuit board so as to allow the socket 50 being attached to a lateral side of the circuit board. The socket 82 at the joining parts 821, 823 thereof can be soldered to corresponding electrical connecting parts 31, 32 respectively and the front plate 822 presses against the lateral side of the circuit board. The socket 95 at the joining parts 955, 953 thereof can be soldered to the corresponding electrical connecting parts 31, 32 of the circuit board.

The socket 83 at the insert pin 832 thereof is inserted into a corresponding hole 333 at the circuit board and the joining parts 831, 834 thereof are soldered to corresponding electrical connecting parts 331, 332. The front plate 833 thereof presses against a lateral side of the circuit board 33. The socket 93 at the insert pin 932 and the joining part 933 thereof is inserted into inserted into corresponding holes 342, 343 at the circuit board 34. The socket 93 at the joining parts 931, 933 thereof is soldered to the corresponding electrical connecting part 341 and the corresponding electrical connecting part in the hole 343 of the circuit board 34. The socket 94 at the downward extending joining parts 941, 942 thereof is inserted into corresponding holes 351, 352 of the circuit board 35 respectively and the joining parts 351, 352 further are soldered at electrical connecting parts in the holes 351, 352.

Figure 13:
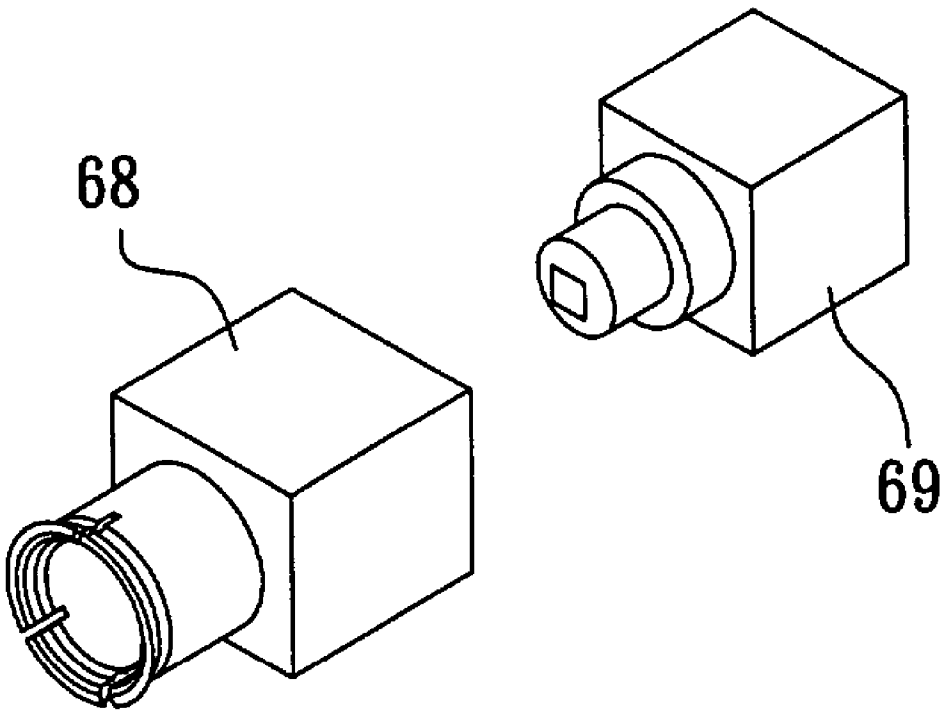
FIG. 13 is a perspective view showing an embodiment of square plug.

With reference to FIG. 13, both the casing 68 and the insulator 69 of the plug can be provided with a square shape of appearance thereof.

While the invention has been described with reference to preferred embodiments thereof, it is to be understood that modifications or variations may be easily made without departing from the spirit of this invention, which is defined by the appended claims.

What is claimed is:

1. A super mini microwave connector, comprising:

a socket, being associated to a circuit board in an electronic product;

wherein, the socket further comprises:

an outer metal casing having a laterally extending joining part; and an insulator being associated with the outer casing, said insulator having a metal male terminal, not in contact with the outer casing, said male terminal having another laterally extending joining part;

wherein the joining parts are joined to a first surface of the circuit board such that the male terminal faces the first surface of the circuit board and the socket being attached to a first side of the circuit board, the first side being adjacent to the first surface and a second surface, wherein the outer casing has a rear cover; and wherein a rear insulator is provided between the rear cover and the insulator and the joining part of the male terminal extends a rearward 90° bent at the lower rear end thereof.

2. The super mini microwave connector according to claim 1, wherein the socket fits with a plug.

3. A super mini microwave connector, comprising:

a socket, being associated to a circuit board in an electronic product;

wherein, the socket further comprises:

an outer metal casing having a laterally extending joining part; and an insulator being associated with the outer casing, said insulator having a metal male terminal, not in contact with the outer casing, said male terminal having another laterally extending joining part;

wherein the joining parts are joined to a first surface of the circuit board such that the male terminal faces the first surface of the circuit board and the socket being attached to a first side of the circuit board, the first side being adjacent to the first surface and a second surface, wherein the outer casing has a rear cover; and wherein the rear cover is composed of two cover plates engaging with each other.

4. The super mini microwave connector according to claim 3, wherein the socket fits with a plug.

* * * * *